US008641413B2

(12) United States Patent
Chen et al.

(10) Patent No.: US 8,641,413 B2
(45) Date of Patent: Feb. 4, 2014

(54) DEVICE FOR PRODUCING STABLE AND AUGMENTED FLAME

(75) Inventors: Wei-Long Chen, Taichung (TW); Jan-Nan Chen, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 374 days.

(21) Appl. No.: 13/045,582

(22) Filed: Mar. 11, 2011

(65) Prior Publication Data

US 2012/0178035 A1 Jul. 12, 2012

(30) Foreign Application Priority Data

Jan. 11, 2011 (TW) ..... 100100952 A

(51) Int. Cl.
*F23D 3/18* (2006.01)

(52) U.S. Cl.
USPC ..... 431/309; 431/288; 431/289; 431/290; 431/291; 431/297; 431/298; 431/300; 431/302; 431/310; 431/312; 431/313; 431/314

(58) Field of Classification Search
USPC ..... 431/288, 289, 290, 291, 297, 298, 300, 431/302, 309, 310, 312, 313, 314
See application file for complete search history.

(56) References Cited

U.S. PATENT DOCUMENTS

| | | | | | |
|---|---|---|---|---|---|
| 2,214,495 | A * | 9/1940 | Yates | 110/287 |
| 2,241,698 | A * | 5/1941 | Hugh | 362/163 |
| D147,730 | S * | 10/1947 | Hussey | D26/6 |
| 2,461,822 | A * | 2/1949 | Hussey | 431/126 |
| 4,185,953 | A * | 1/1980 | Schirneker | 431/291 |
| 4,216,908 | A * | 8/1980 | Sakurai et al. | 239/132.3 |
| 7,044,320 | B2 * | 5/2006 | Mladenovic | 220/23.87 |
| 7,097,448 | B2 | 8/2006 | Chesney | 431/353 |
| D621,873 | S | 8/2010 | Tsai | D19/26 |
| D622,318 | S * | 8/2010 | Tsai et al. | D19/62 |
| 2004/0188436 | A1 * | 9/2004 | Mladenovic | 220/23.87 |
| 2007/0042307 | A1 * | 2/2007 | De Marcos et al. | 431/350 |
| 2007/0111149 | A1 * | 5/2007 | Matsuyama | 431/300 |
| 2009/0004067 | A1 * | 1/2009 | Furner et al. | 422/126 |
| 2009/0016048 | A1 * | 1/2009 | McBrien et al. | 362/180 |
| 2010/0104993 | A1 * | 4/2010 | Ryser | 431/252 |
| 2010/0154779 | A1 * | 6/2010 | Andors et al. | 126/512 |
| 2012/0006316 | A1 * | 1/2012 | Shimek et al. | 126/519 |

* cited by examiner

*Primary Examiner* — Kenneth Rinehart
*Assistant Examiner* — Jorge Pereiro
(74) *Attorney, Agent, or Firm* — Alan Kamrath; Kamrath IP Lawfirm, P.A.

(57) ABSTRACT

A device for producing a stable and augmented flame includes a fluid-inducing assembly and a shield. The fluid-inducing assembly includes a flow-diverting mechanism defining a flow-intake end and a flow-accelerating end and includes a plurality of vanes extending from the flow-intake end to the flow-accelerating end. The plurality of vanes is circumferentially disposed and spaced from one another. Furthermore, two vanes include a space defined therebetween, and the space defines a passage which is spiral-shaped. The flow-diverting mechanism further includes a covering member with an enclosed circumferential edge circumferentially surrounded. Thus, each vane in the flow-accelerating end is encircled by the covering member, and each vane in the flow-intake end is exposed to outside and not covered by the covering member. In addition, the shield is hollow and is disposed above the fluid-inducing assembly.

19 Claims, 13 Drawing Sheets

DEVICE FOR PRODUCING STABLE AND AUGMENTED FLAME

BACKGROUND OF THE INVENTION

1. Field of the Invention

The present invention relates to a device for producing a flame and, in particular, to a device that is adapted to produce a stable and augmented flame.

2. Description of the Related Art

U.S. Pat. No. 7,097,448 discloses a vortex type gas lamp for producing an upwardly-directed vortex flame of combustible gas inside a surrounding and confined boundary of a rotating body of air. An interface is located between the body of air which is devoid of gas and a central region of gas which is bounded by the interface during the operation of the gas lamp. All of the combustion of gas substantially occurs inside the interface. The gas lamp has a central axis and includes a base supplying combustible gas without air at and nearly adjacent to the central axis. The gas lamp further includes a shield including first and second axially-extending sections structurally attached to the base in a fluid-sealing relationship. The first and second sections are substantially identical and are transparent to light, and each includes an impermeable wall having an arcuate inner surface and an arcuate outer surface. Furthermore, each of the first and second sections has a first edge and a second edge extending axially from end to end. The gas lamp further includes first and second walls alternately overlapping one another. The first and second walls are adjacent to their edges and are spaced from one another to form tangentially-directed ports, thereby forming an axially-extending chamber open at its side only through the ports. In addition, the first and second sections are so arranged at the base to surround the entry of the combustible gas, and the combustible gas receives air for combustion only through the ports. Whereby, combustion of the gas results in a flame spaced from the inner surfaces, and the peripheral body of air is devoid of gas entering through the ports. In this gas lamp, air would flow through the ports in a direction perpendicular to a flow direction of combustible gas, and it is difficult to augment the height of the flame while stably maintaining the shape thereof. In this regard, the gas lamp produces a flame that is constrained to a height in order to stably maintain the shape thereof.

Furthermore, U.S. Design Pat. No. 621,873 discloses a fire tornado lamp including a base and a shield. The base includes a plurality of ports disposed circumferentially. The shield is transparent to light and is hollow. That is, it includes a passage extending therein. In addition, the base and the shield are connected to each other, and each port extends radially with respect to the passage defined in the shield and communicates therewith. In addition, each port is so configured so that it induces air into the passage in a direction substantially tangential to a circumference of the passage. Likewise, air would flow through the ports in a direction perpendicular to a flow direction of gas, and it is difficult to augment the height of the flame while stably maintaining the shape thereof. In this regard, the lamp produces a flame that is constrained to a height in order to stably maintain the shape thereof.

The present invention is, therefore, intended to obviate or at least alleviate the problems encountered in the prior art.

SUMMARY OF THE INVENTION

According to the present invention, a device for producing a stable and augmented flame includes a fluid-inducing assembly and a shield. The fluid-inducing assembly includes a flow-diverting mechanism defining a flow-intake end and a flow-accelerating end and includes a plurality of vanes extending from the flow-intake end to the flow-accelerating end. Furthermore, the plurality of vanes is circumferentially disposed and spaced from one another. Two vanes include a space defined therebetween, and the space defines a passage which is spiral-shaped. The flow-diverting mechanism further includes a covering member with an enclosed circumferential edge circumferentially surrounded, such that where each vane in the flow-accelerating end is encircled by the covering member and where each vane in the flow-intake end is exposed to outside and not covered by the covering member. In addition, the shield is hollow and is disposed above the fluid-inducing assembly.

In use of the device for producing a stable and augmented flame, external air is induced into each passage through the flow-intake end and flows therealong and exits from the flow-accelerating end and into the shield thereafter. Furthermore, the external air is directed by the passages and is swirled and is accelerated, with the flow-accelerating end accelerating the air. Whereby, a flame produced in the device is swirled, and a height thereof is augmented, while a shape thereof is maintained stable. Additionally, the flow-intake end is located at a lower position only, and the flame is located at a higher position.

Other objects, advantages, and new features of the present invention will become apparent from the following detailed description of the invention when considered in conjunction with the accompanied drawings.

DETAILED DESCRIPTION OF THE PREFERRED EMBODIMENTS

Figure 1:
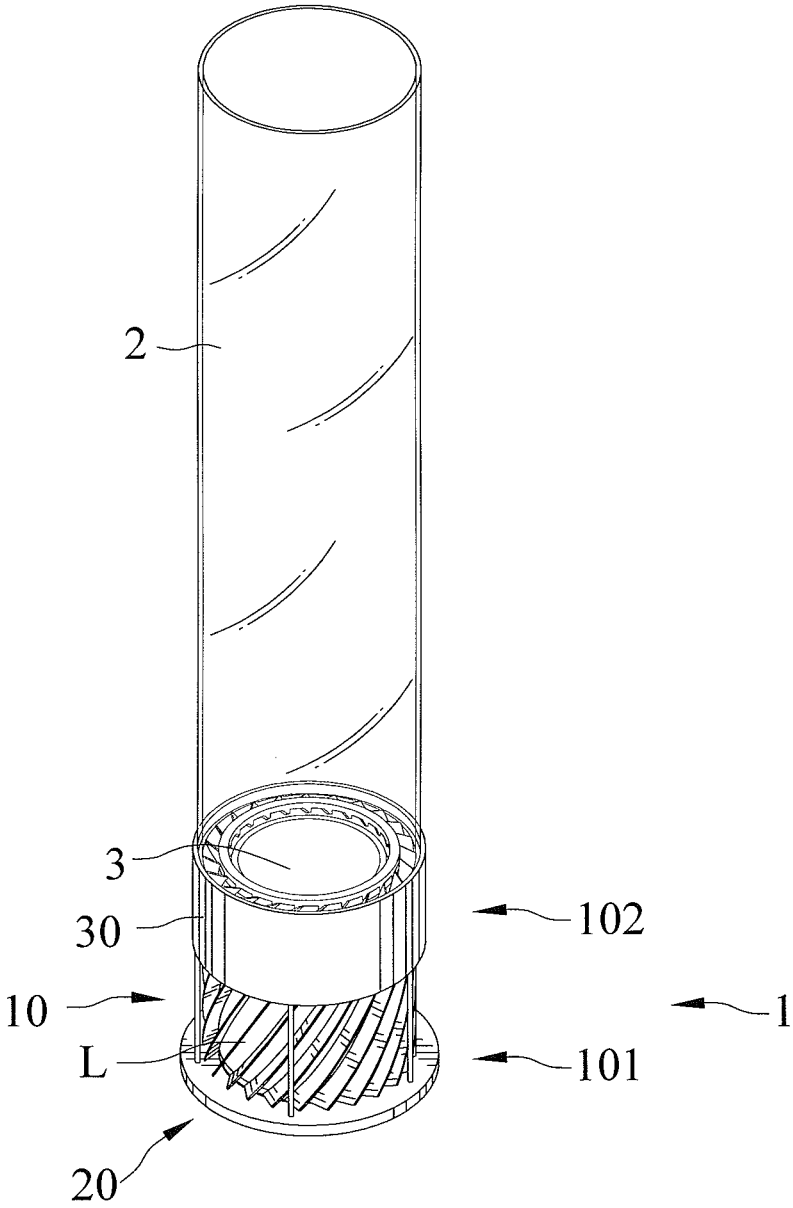
FIG. 1 is a perspective view of a device for producing a stable and augmented flame in accordance with a first embodiment of the present invention.
Figure 2:
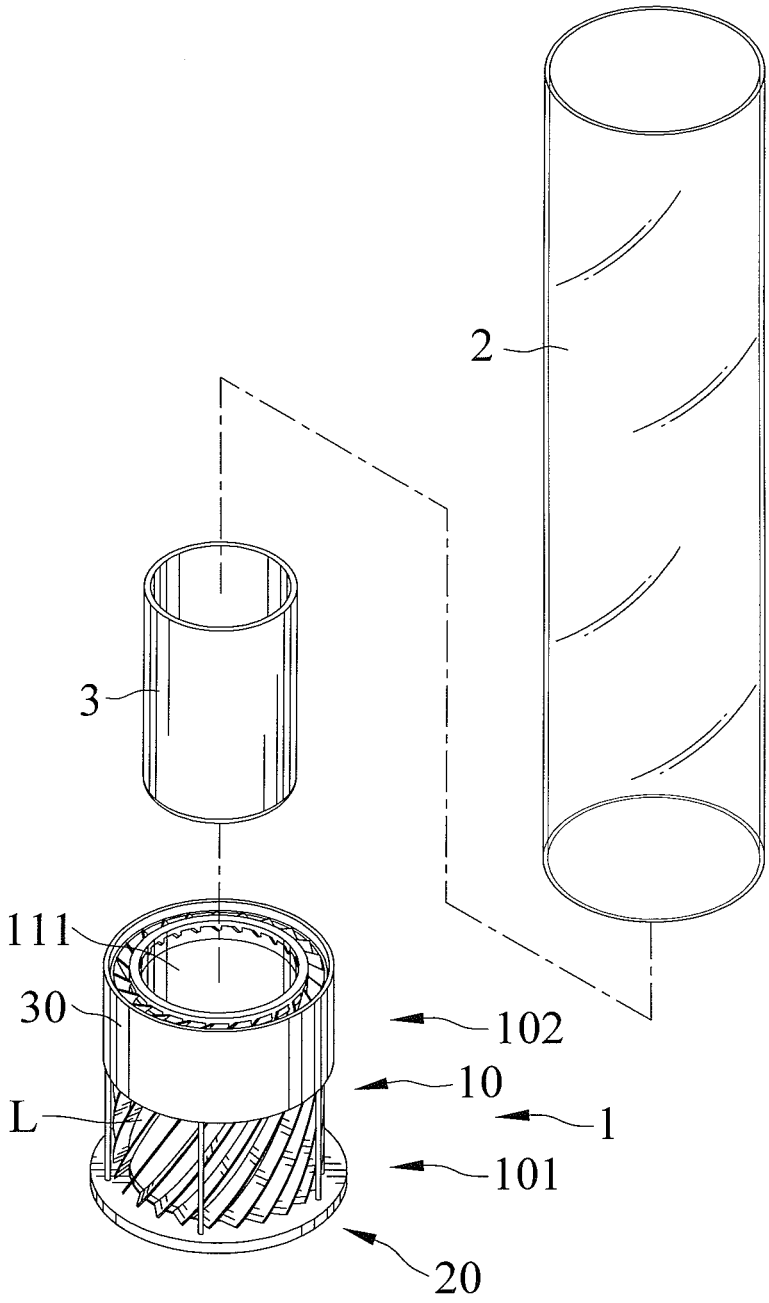
FIG. 2 is an exploded perspective view of the device for producing a stable and augmented flame.
Figure 3:
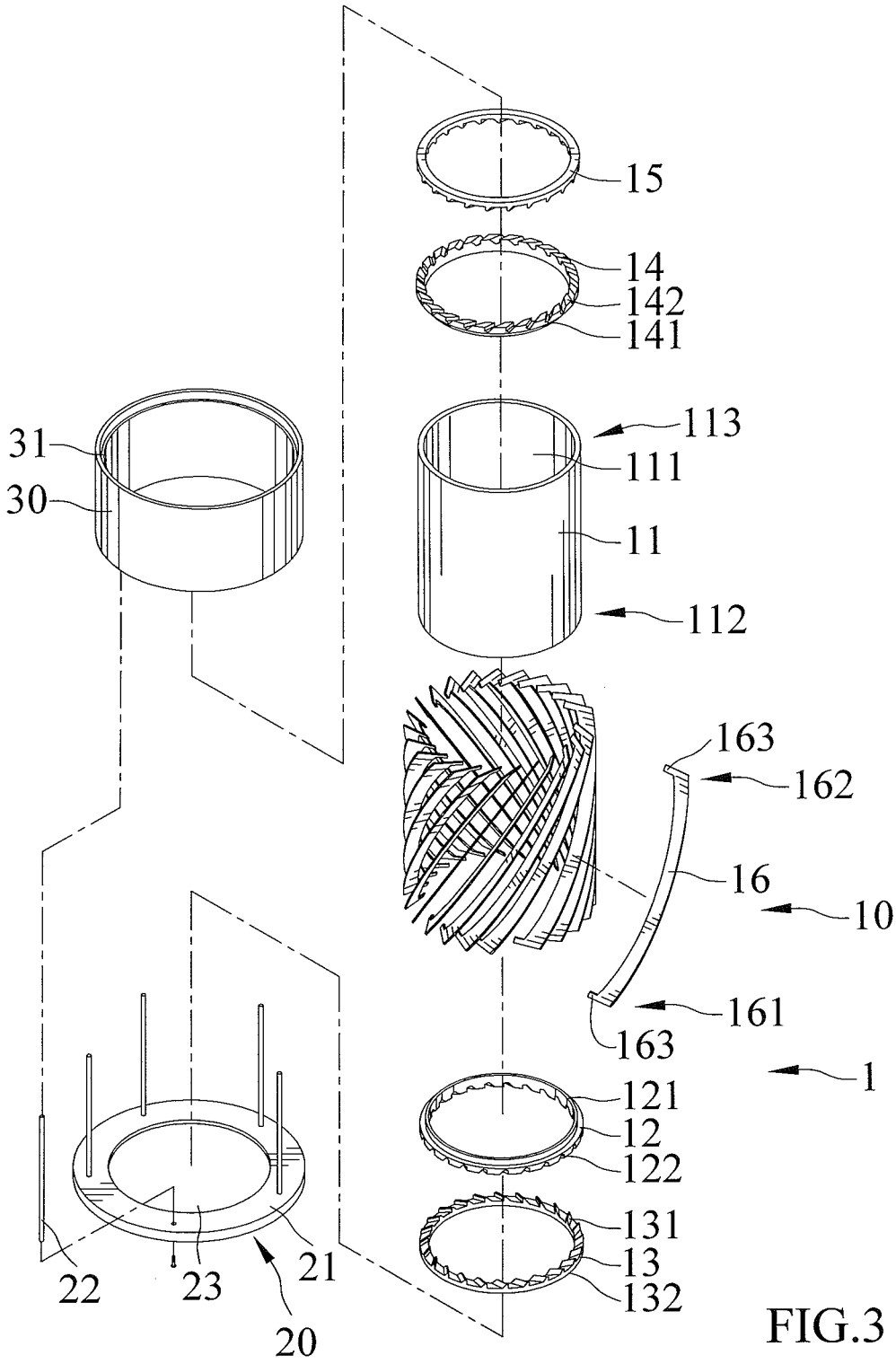
FIG. 3 is a further exploded perspective view of the device for producing a stable and augmented flame.
Figure 4:
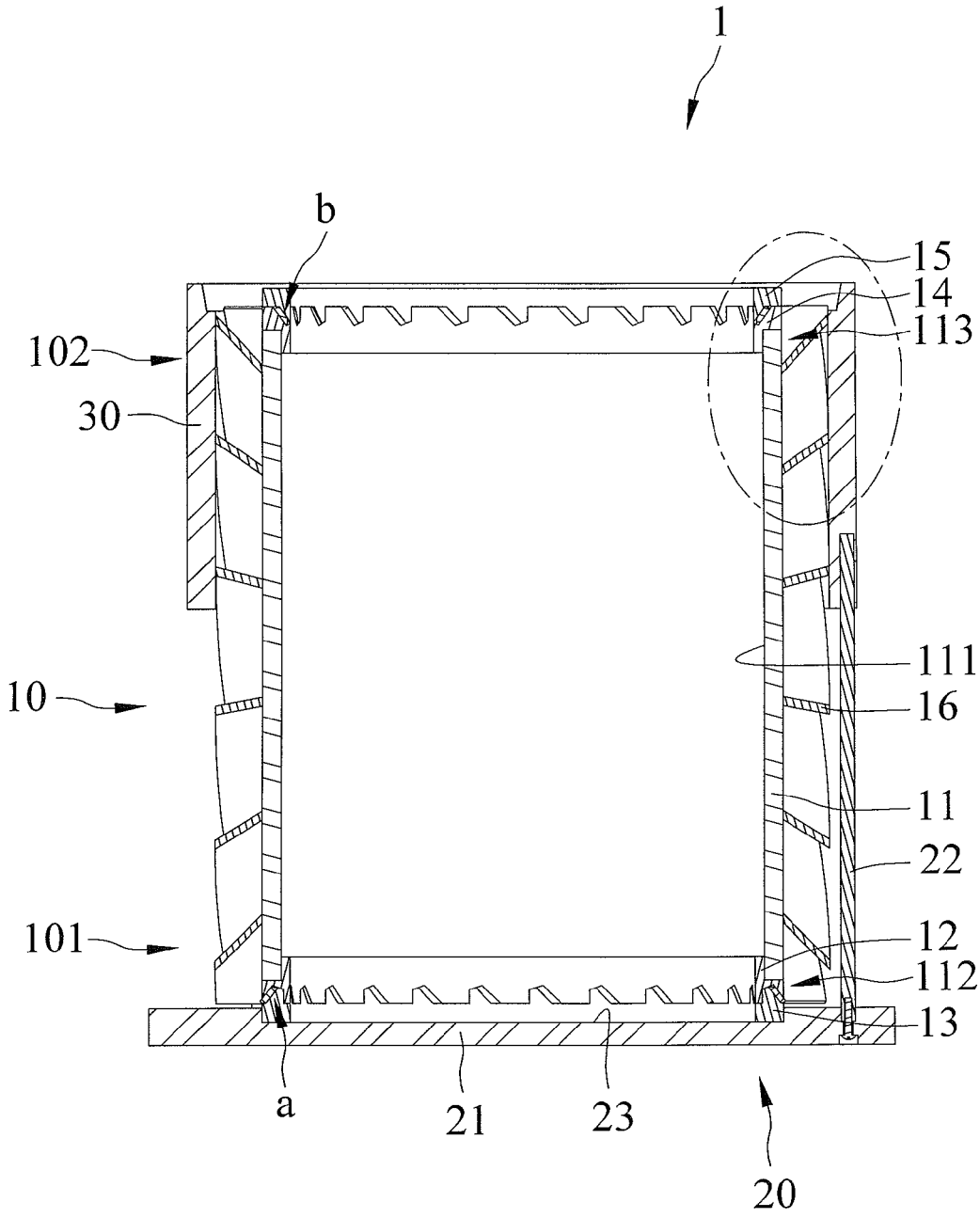
FIG. 4 is a cross-sectional view showing a fluid-inducing assembly of the device for producing a stable and augmented flame, with the fluid-inducing assembly including a flow-diverting mechanism, a base, and a covering member.
Figure 5:
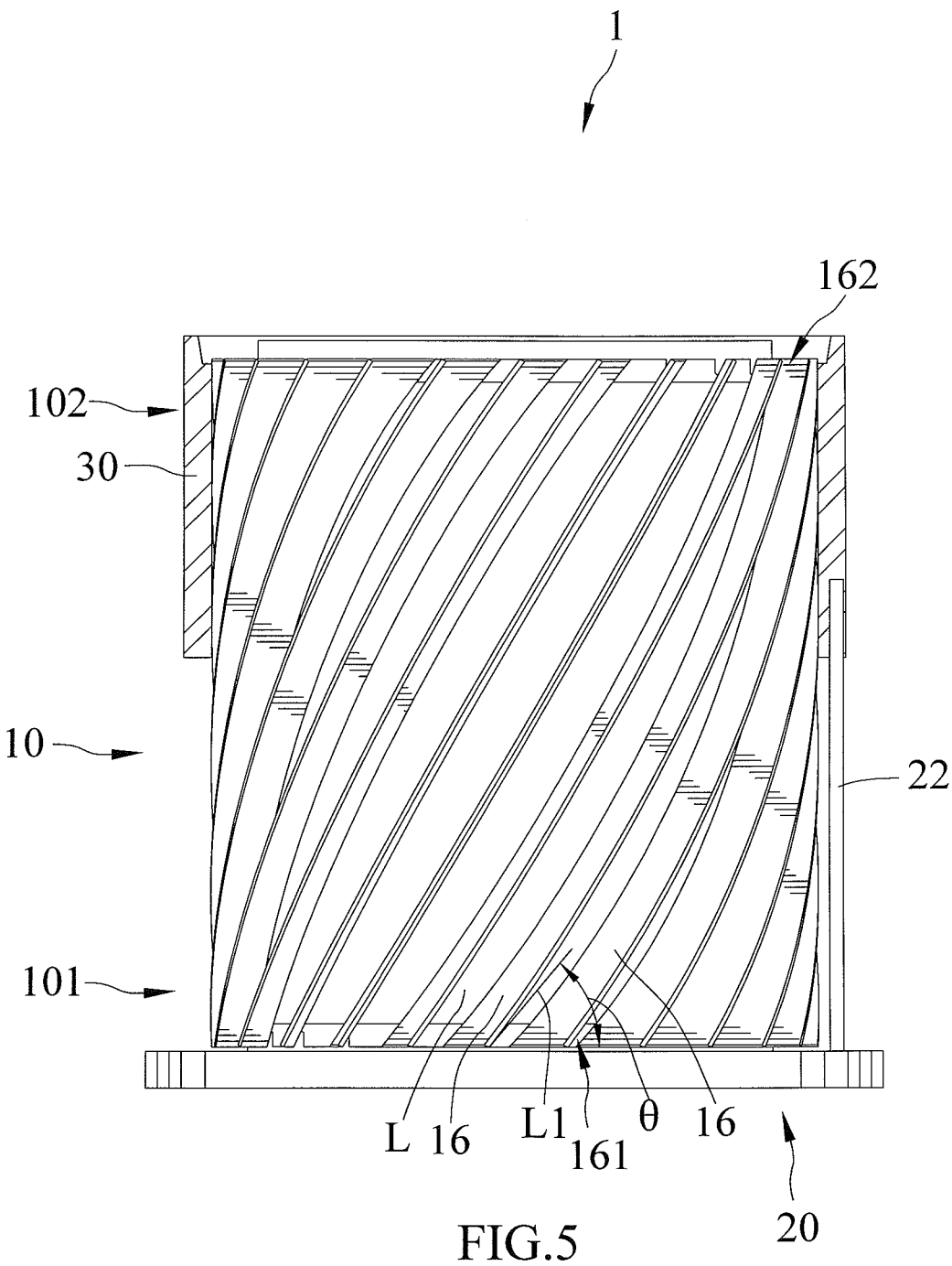
FIG. 5 is a cross-sectional view showing spiral passages of the flow-diverting mechanism.
Figure 6:
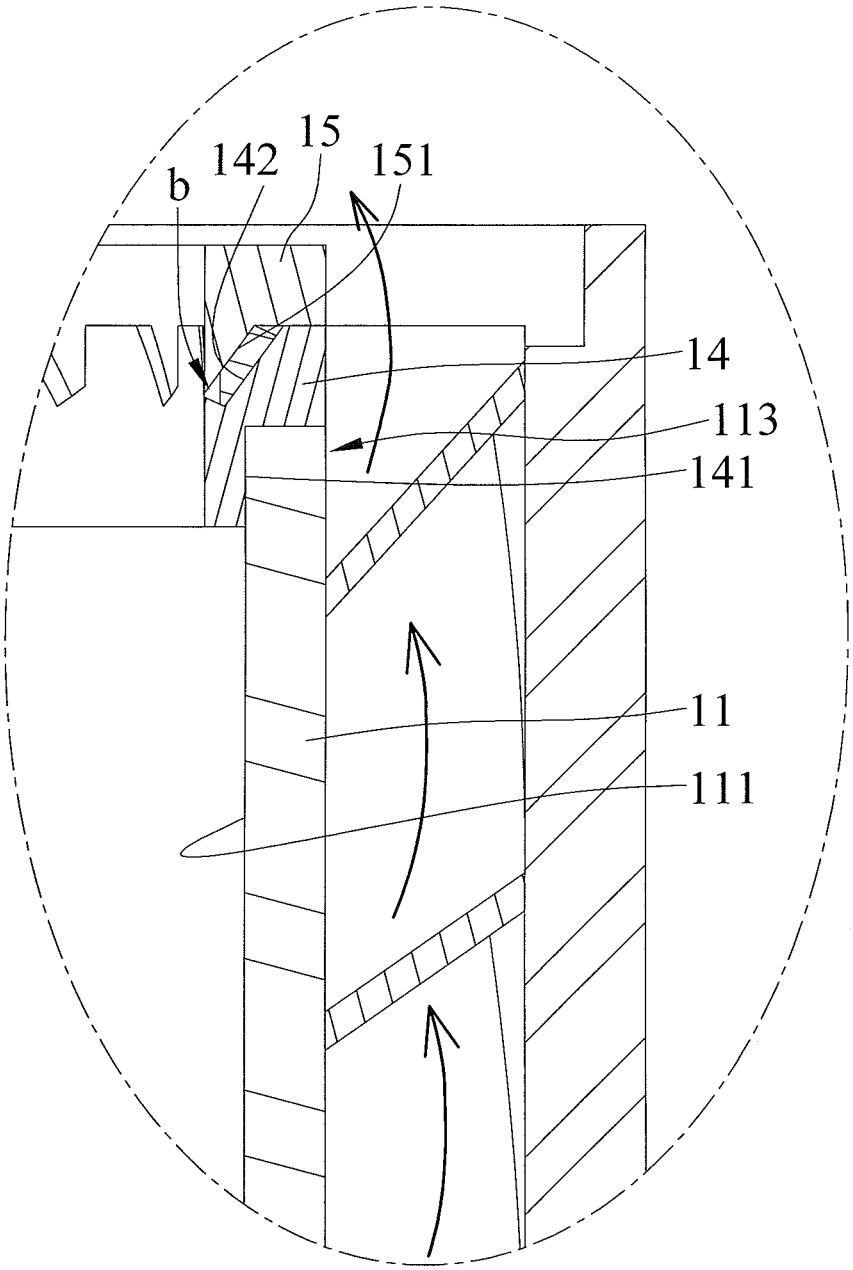
FIG. 6 is a partial, enlarged view of FIG. 4 and shows the flow of air in the flow-diverting mechanism.
Figure 7:
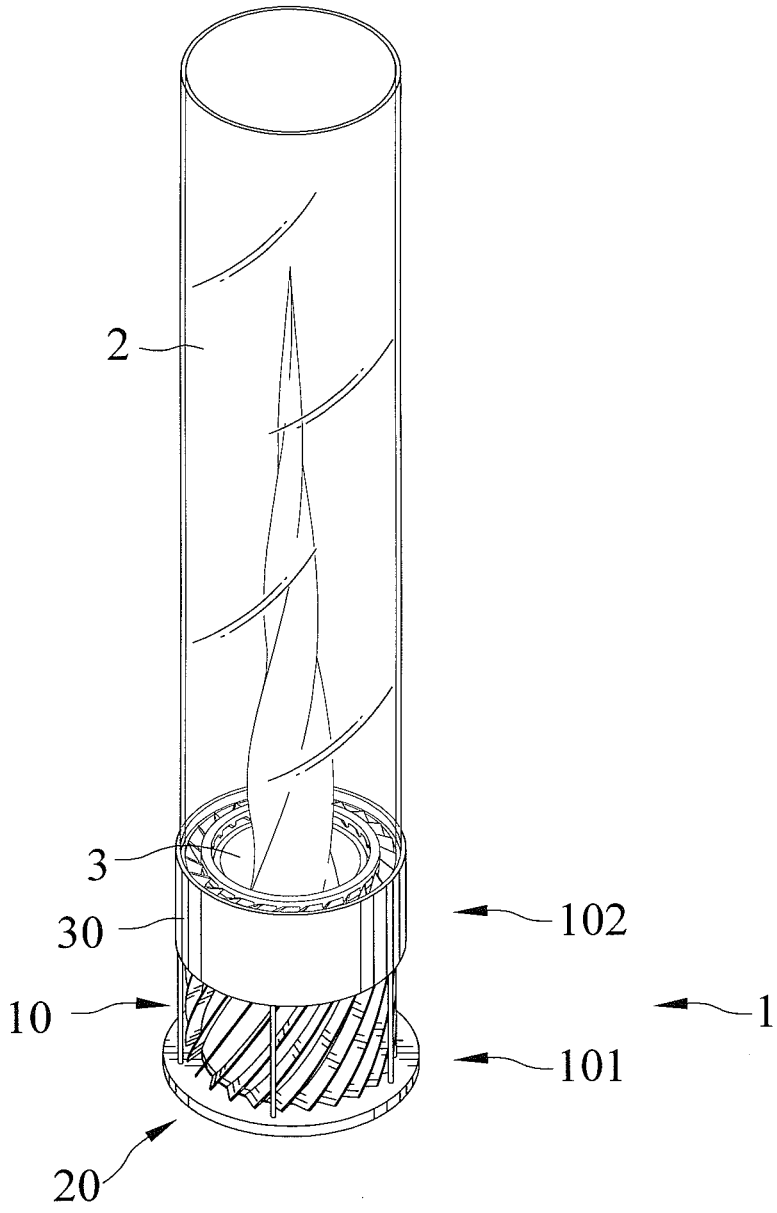
FIG. 7 is a perspective view showing the device for producing a stable and augmented flame in use.
Figure 8:
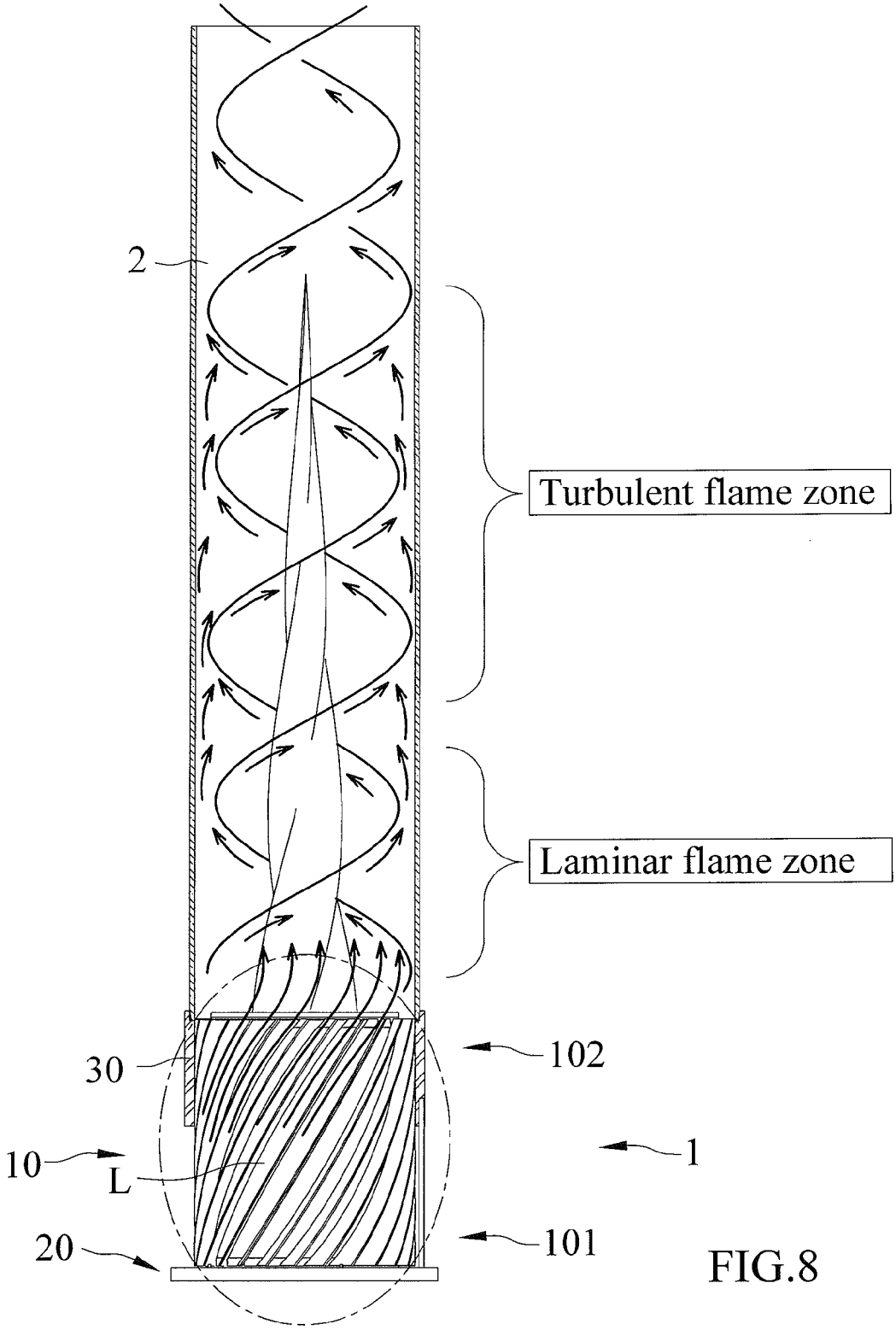
FIG. 8 is a cross-sectional view showing the device for producing a stable and augmented flame in use and air swirled to augment the height of the flame.
Figure 9:
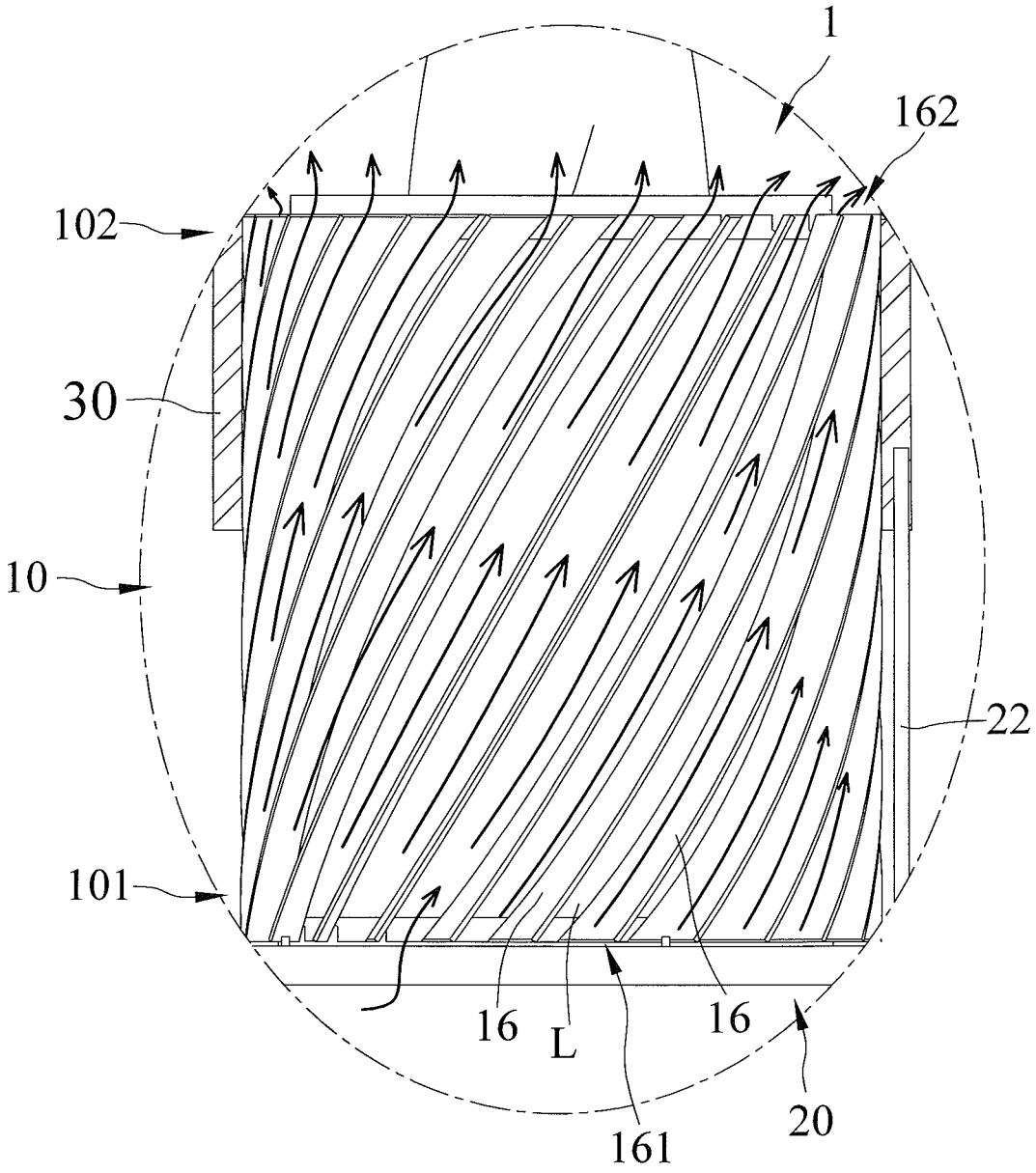
FIG. 9 is a partial, enlarged view of FIG. 8 and shows the flow of the air through the spiral passages.
Figure 10:
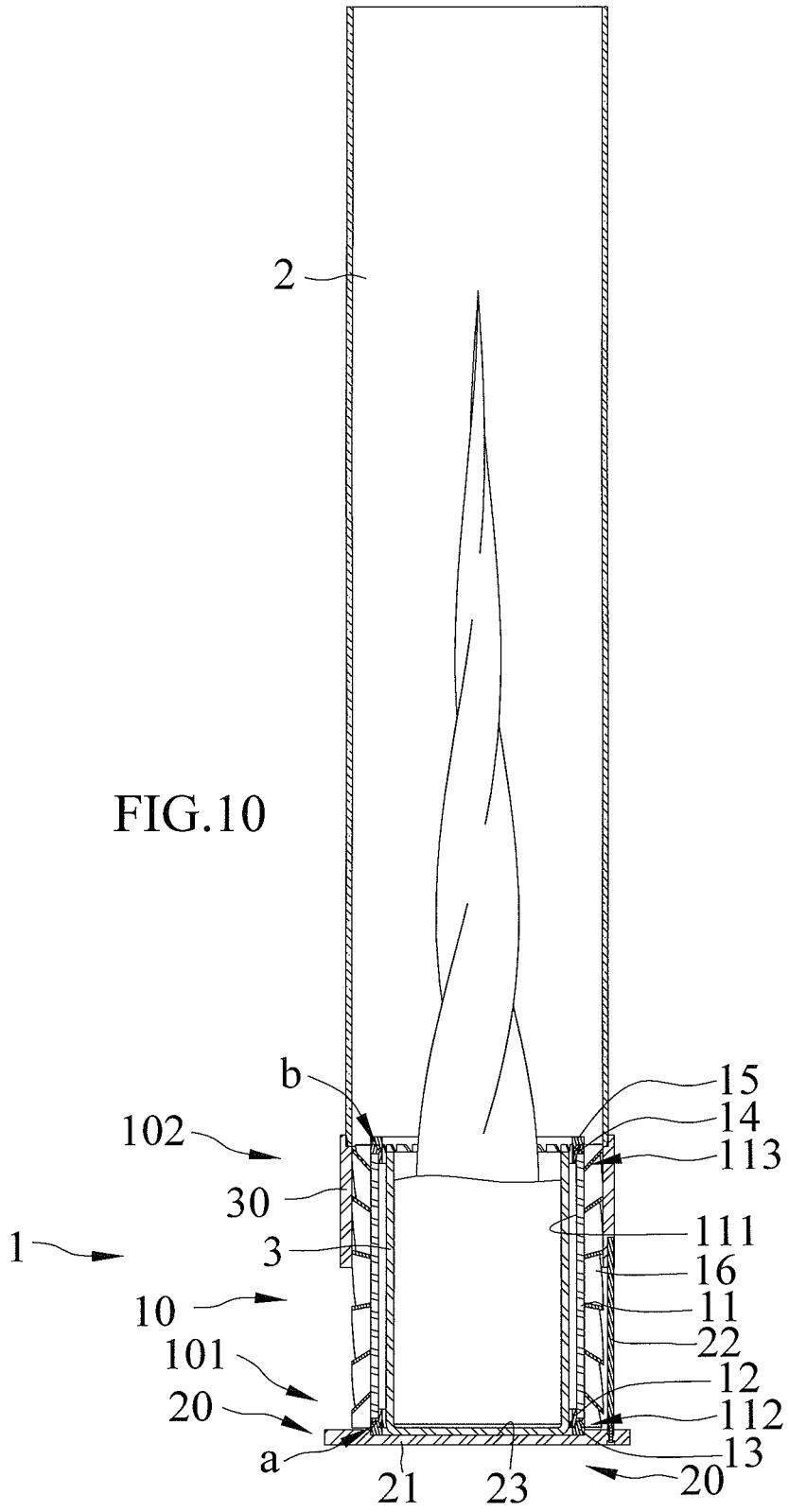
FIG. 10 is another cross-sectional view showing the device for producing a stable and augmented flame in use.

FIGS. 1 through 10 show a device for producing a stable and augmented flame in accordance with a first embodiment of the present invention. The device includes a fluid-inducing assembly 1, a shield 2 and a container 3.

The fluid-inducing assembly 1 includes a flow-diverting mechanism 10, a base 20, and a covering member 30. The flow-diverting mechanism 10 is disposed on the base 20. The flow-diverting mechanism 10 includes an end which defines a flow-intake end 101 disposed adjacent to the base 20 and an end which defines a flow-accelerating end 102 disposed adjacent to the covering member 30 and is opposite to the base 20. The flow-diverting mechanism 10 further includes a tube 11, a first engaging member 12, a first enclosure member 13, a second engaging member 14, a second enclosure member 15, and a plurality of vanes 16. The tube 11 is hollow and includes an enclosed peripheral wall 111. Furthermore, the tube 11 defines a first distal end 112 and a second distal end 113 and extends longitudinally from the first distal end 112 to the second distal end 113. The first engaging member 12 is in the form of a ring with an enclosed circumferential edge and includes a first connecting edge 121 and a first receiving edge 122. Furthermore, the first engaging member 12 is engaged with the first distal end 112 of the tube 11. That is, the first engaging member 12 includes the first connecting edge 121 engaged with the first distal end 112 of the tube 11. Likewise, the first connecting edge 121 extends circumferentially along the circumferential edge of the first engaging member 12. The first receiving edge 122 is defined from a plurality of ridges and recesses alternately disposed and circumferentially disposed along the circumferential edge of the first engaging member 12. Moreover, each recess of the first receiving edge 122 extends radially and non-concentrically. The first enclosure member 13 is in the form of a ring with an enclosed circumferential edge and includes a first joining edge 131 and a first fixing edge 132. Furthermore, the first enclosure member 13 is engaged with the first engaging member 12. That is, the first enclosure member 13 includes the first joining edge 131 engaging with the first receiving edge 122 of the first engaging member 12. Likewise, the first joining edge 131 is defined from a plurality of ridges and recesses alternatively disposed and circumferentially disposed along the circumferential edge of the first enclosure member 13, and the recesses and the ridges of the first receiving edge 122 engage with the ridges and the recesses of the first joining edge 131 respectively when in engagement therewith. Moreover, each recess of the first joining edge 131 extends radially and non-concentrically. Further, a plurality of first gaps "a" formed as the first receiving edge 122 and the first joining edge 131 are engaged with each other. Likewise, the first enclosure member 13 is engaged with the base 20. That is, the first enclosure member 13 includes the first fixing edge 132 engaged in a cavity 23 defined in a body 21 of the base 20 and is restricted from moving relative to the base 20. The second engaging member 14 is in the form of a ring with an enclosed circumferential edge and includes a second connecting edge 141 and a second receiving edge 142. Furthermore, the second engaging member 14 is engaged with the second distal end 113 of the tube 11. That is, the second engaging member 14 includes the second connecting edge 141 engaged with the second distal end 113 of the tube 11. Likewise, the second connecting edge 141 extends circumferentially along the circumferential edge of the second engaging member 14. The second receiving edge 142 is defined from a plurality of ridges and recesses alternately disposed and circumferentially disposed along the circumferential edge of the second engaging member 14. Moreover, each recess of the second receiving section 142 extends radially and non-concentrically. The second enclosure member 15 is in the form of a ring with an enclosed circumferential edge and includes a second joining edge 151. Furthermore, the second enclosure member 15 is engaged with the second engaging member 14. That is, the second enclosure member 15 includes the second joining edge 151 engaging with the second receiving edge 142 of the second engaging member 14. Likewise, the second joining edge 151 is defined from a plurality of ridges and recesses alternatively disposed and circumferentially disposed along the circumferential edge of the second enclosure member 15, and the recesses and the ridges of the second receiving edge 142 engage with the ridges and the recesses of the second joining edge 151 respectively when in engagement therewith. Moreover, each recess of the second joining edge 151 extends radially and non-concentrically. Further, a plurality of second gaps "b" formed as the second receiving edge 142 and the second joining edge 151 are engaged with each other. The plurality of vanes 16 is separately formed from the tube 11, is circumferentially disposed outside the tube 11 and is spaced from one another. That is, two vanes 16 include a space defined therebetween, and the space defines a passage "L" which is spiral-shaped. Also, each vane 16 obliquely extends longitudinally from a first end 161 to a second end 162 and is parallel to the other vanes 16. Furthermore, each vane 16 includes two attaching ends 163 extending from the first and second ends 161 and 162, respectively, in the same direction, and one attaching end 163 is secured to the first engaging member 12 and the first enclosure member 13. That is, the attaching end 163 is inserted into and engages in one of the plurality of gaps "a", while the other attaching end 163 is secured to the second engaging member 14 and the second enclosure member 15. That is, the attaching end 163 is inserted into and engages in one of the plurality of gaps "b". Additionally, each passage "L" includes an included angle "θ" defined between a tangent "L1" thereof which extends from where the passage "L" and the first engaging member 12 interact and a terminal of the passage "L" in the flow-intake end 101. Furthermore, in order to achieve the goal to produce a stable and augmented flame, the plurality of vanes 16 is numbered in a range from 12 to 24. Thus, the plurality of passages "L" is numbered in a range from 11 to 23, and each vane 16 extends from the first end 161 to the second end 162 at an angle, which can range from 30-55 degrees.

The covering member 30 is in the form of a ring with an enclosed circumferential edge and circumferentially surrounds the flow-accelerating end 102 of the flow-diverting mechanism 10, such that each vane 16 in the flow-accelerating end 102 is encircled by the covering member 30. In addition, each vane 16 in the flow-intake end 101 is exposed to outside and not covered by the covering member 30. Furthermore, in order for the covering member 30 not to cover the flow-intake end 101, the covering member 30, which is fixed to the base 20, is spaced from the body 21 of the base 20 by a plurality of supports 22. The supports 22 are disposed in a spaced relationship with each other. Each support 22 extends upwardly from the body 21 and includes two terminal ends, with one terminal end fixed to the body 21 and the other terminal end fixed to the covering member 30. The covering member 30 further includes a groove 31 extending along the circumferential edge thereof for receiving the shield 2, which will be described in more detail thereafter.

The shield 2 with an enclosed circumferential edge is transparent to light, is hollow and is disposed above the fluid-inducing assembly 1. Furthermore, the shield 2 extends upwardly from the fluid-inducing assembly 1. In addition, as set forth in the last paragraph, the covering member 30 is utilized to support the shield 2. That is, the shield 2, which extends longitudinally from a first terminal end to a second terminal end, includes the first terminal end supported by the covering member 30 and engaging in the groove 31.

Fuel is filled in the container 3, and the container 3 is received in the fluid-inducing assembly 1. Thus the container 3 is disposed in the tube 11 and is circumferentially surrounded by the plurality of vanes 16 disposed circumferentially outside the tube 11. Preferably, kerosene, gas liquid, and ethanol are selections of the fuel. In addition, the container 3 includes an opening (not numbered) to allow a flame produced by the device embodying the present invention to extend into the shield 2. Moreover, the fluid-inducing assembly 1 is positioned below the bottom of the flame and the passages "L" are positioned below the opening of the container 3 for increasing the overall height of the flame and keeping the shape thereof stable. Such organizations are not taught in any conventional designs.

In use of the device for producing a stable and augmented flame, fuel in the container 3 is ignited to produce a flame. External air is induced into each passage "L" through the flow-intake end 101, flows therealong and exits from the flow-accelerating end 102 and into the shield 2 thereafter. As the external air is directed by the passages "L", it is swirled. Furthermore, the external air is accelerated by the flow-accelerating end 102. Therefore, the flame is swirled. In addition, the flame has two different flame zones, namely a laminar flame zone and a turbulent flame zone. The occurrence of the turbulent flame zone is postponed by the device embodying the present invention in order to augment the overall length of the flame. A break point is in the transition of the laminar flame zone and the turbulent flame zone. In addition, because air is liable to a centrifugal effect and the Coanda Effect, it can keep swirling as if interwoven in the shield 2. Also, negative pressure is created near the exit of the shield 2, and the convection of air is augmented due to the stack effect, thereby prolonging the overall length of the flame.

Figure 11:
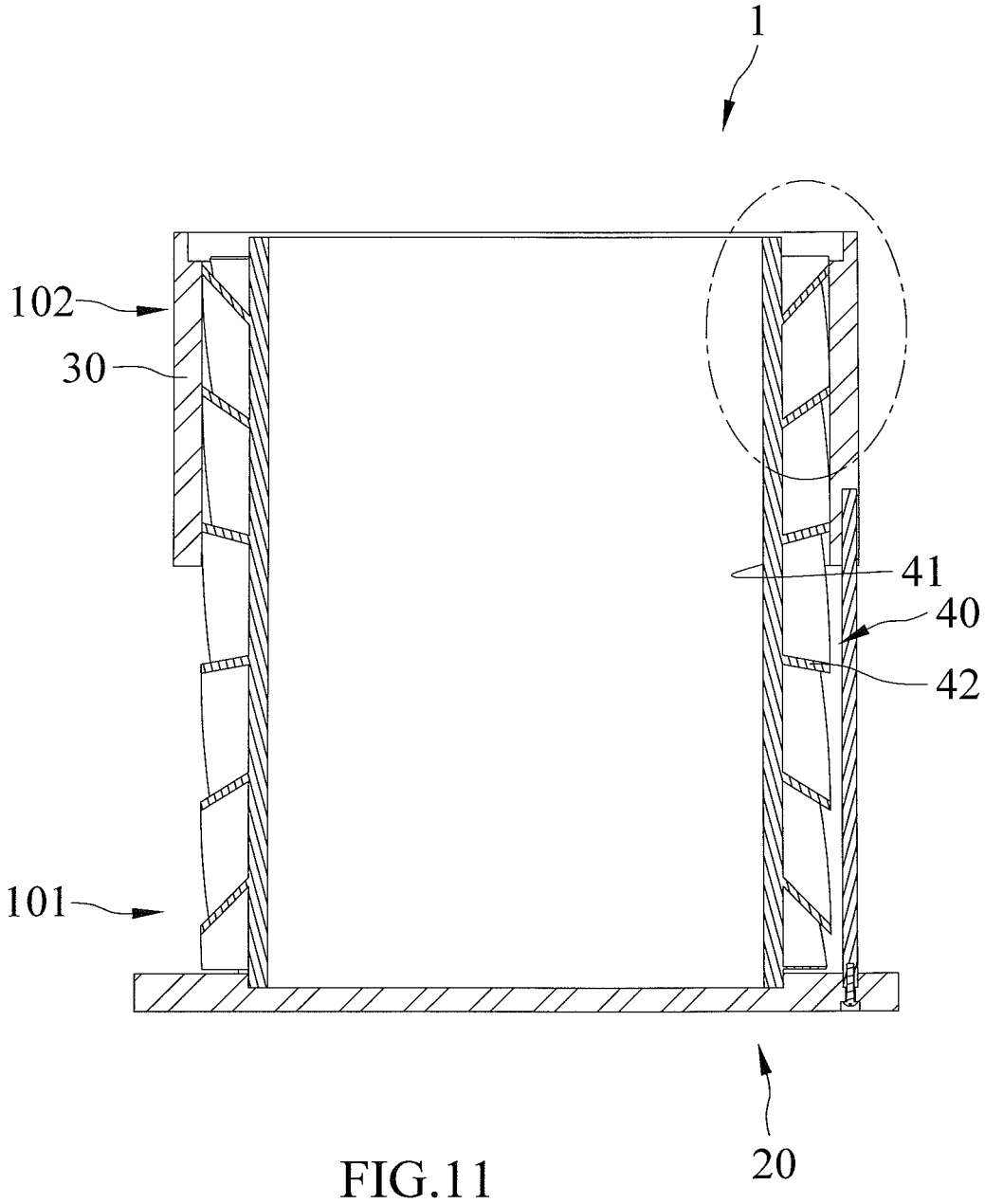
FIG. 11 is a cross-sectional view showing a flow-diverting mechanism in accordance with a second embodiment of the present invention.
Figure 12:
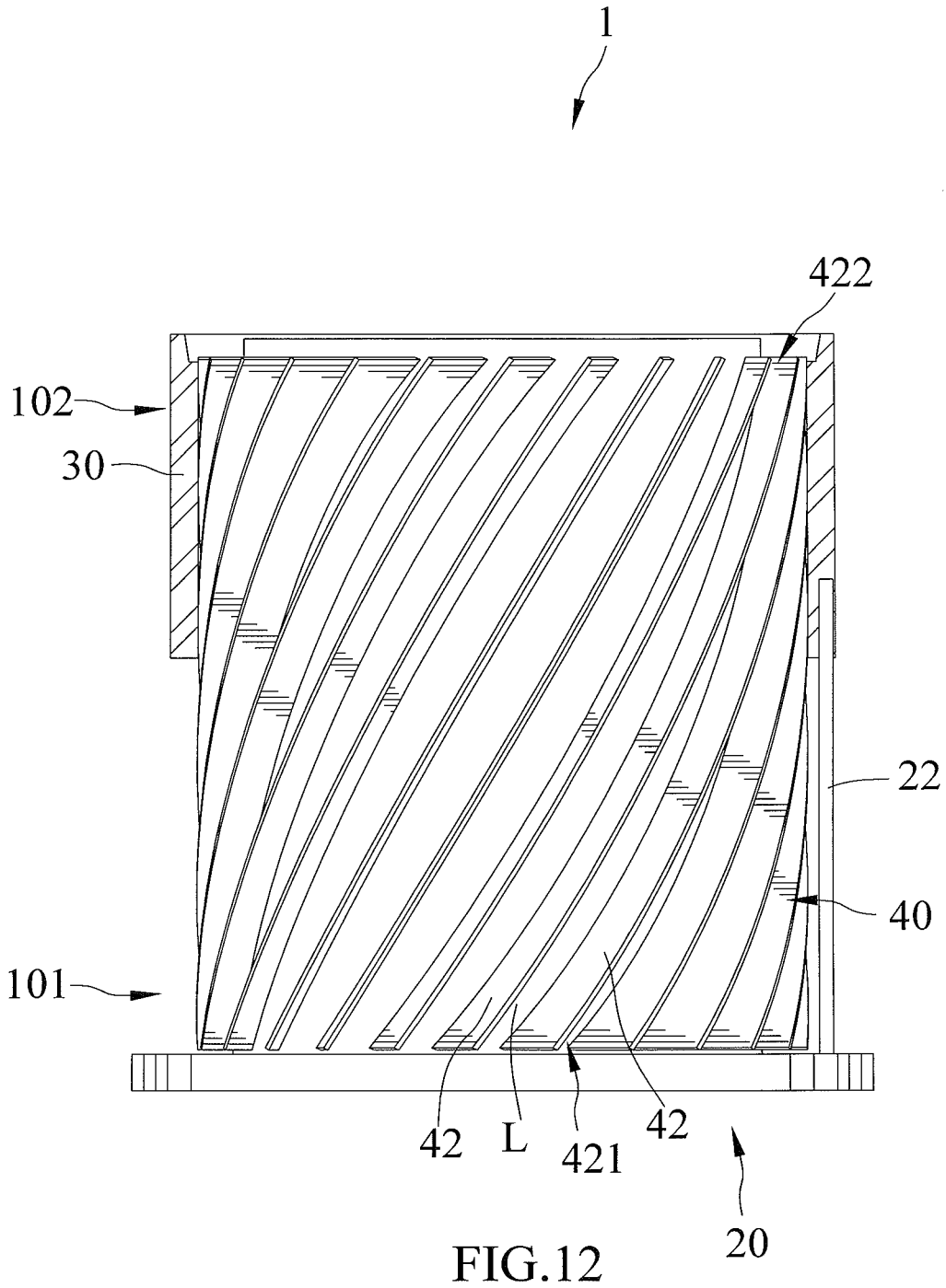
FIG. 12 is a cross-sectional view showing spiral passages of the flow-diverting mechanism shown in FIG. 11.
Figure 13:
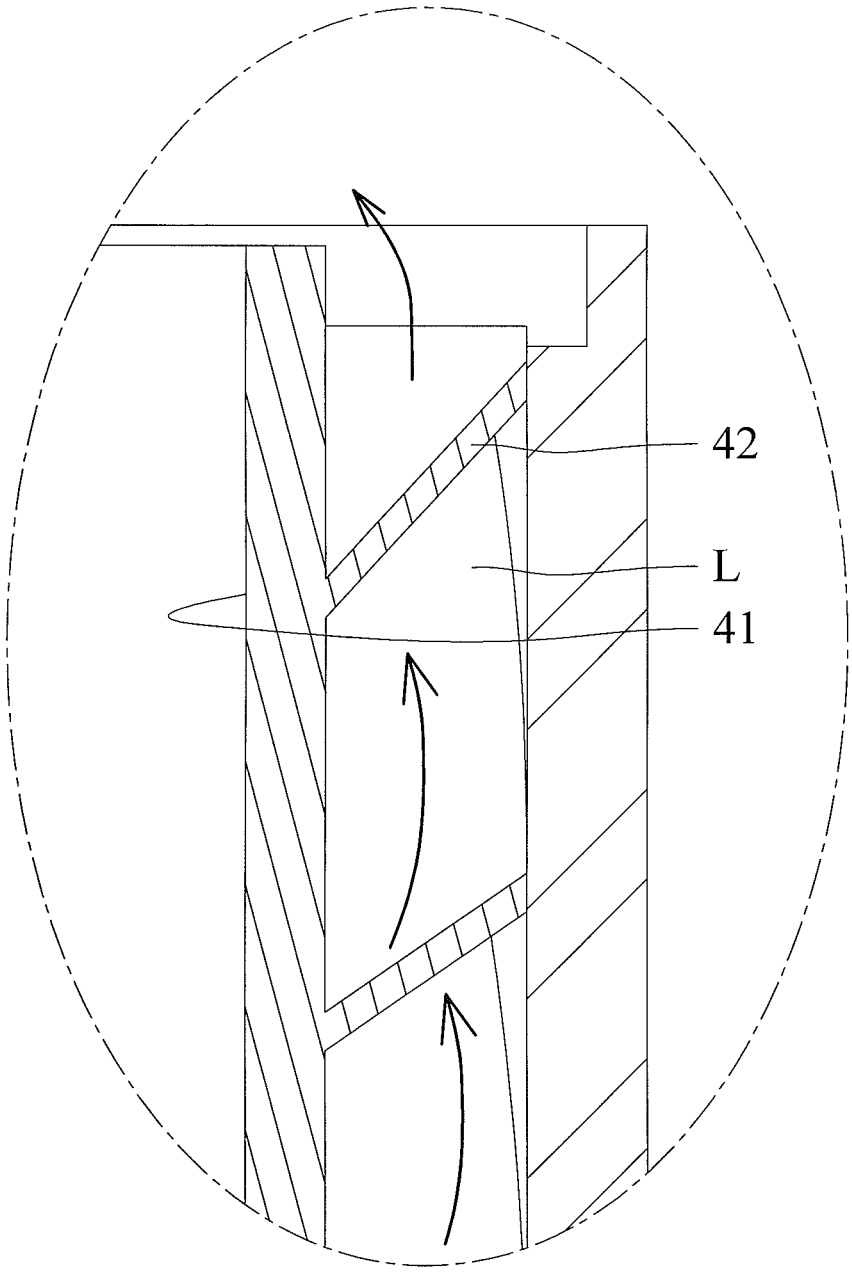
FIG. 13 is a partial, enlarged view of FIG. 11 and shows the flow of air in the flow-diverting mechanism.

FIGS. 11 through 13 show a flow-diverting mechanism 40 in accordance with a second embodiment of the present invention. The difference between the flow-diverting mechanism 40 and the flow-diverting mechanism 10 is that the flow-diverting mechanism 40 includes a tube 41 and a plurality of vanes 42 integrally formed as one piece, whereas the flow-diverting mechanism 10 includes the tube 41 and the plurality of vanes 16 formed separately. Likewise, the tube 41 defines a first distal end 421 and a second distal end 422 and extends longitudinally from the first distal end 421 to the second distal end 422.

It is noticed that the conventional designs described teach that the mixing air is guided perpendicular to the flame and that the venting ports are positioned above a burning canister or a fuel container opening. In contrast, the flow-intake end 101 is located at a lower position only, and the flame is located at a higher position. Therefore, the advantages of the present invention is, first, external air is able to cool down the temperature of the components of the device more effectively than conventional devices, second, a stable fluid boundary can be formed to prevent external air blowing directly to and interfering with the flame allowing a stabilized shape of the flame to be produced, and third, the shield 2 can form a "semi-open space". That is, only the top opening of the shield 2 allows the exit of the air, and the bottom opening of the shield 2 allows the entry of the air, which reduces the flame being affected externally (note that each of the conventional devices form a "open space", and external air can flow laterally through the shield thereof).

Additionally, when a user closes the top opening of the shield 2, the flame is extinguished. However, closing the top opening of the shield of any conventional device just makes a flame produced reduced in size, because air convection still exists.

Although a swirling flame can be produced by these conventional designs, such designs can not help stretch a laminar flame zone of the swirling flame. Rather, the laminar flame zone is shorted, and a turbulent flame zone of the swirling flame would appear earlier in comparison with the device embodying the present invention.

While the specific embodiments have been illustrated and described, numerous modifications come to mind without significantly departing from the spirit of invention, and the scope of invention is only limited by the scope of accompanying claims.

What is claimed is:

1. A device for producing a stable and augmented flame comprising:

a fluid-inducing assembly including a flow-diverting mechanism defining a flow-intake end and a flow-accelerating end and including a plurality of vanes extending spirally from the flow-intake end to the flow-accelerating end and circumferentially disposed and spaced from one another, with adjacent two vanes of the plurality of vanes including a space defined therebetween and with the space defining a passage which is spiral-shaped, and with the flow-diverting mechanism further including a covering member with an enclosed circumferential edge circumferentially surrounded, wherein each vane extending spirally in the flow-accelerating end is encircled by the covering member, and wherein each vane extending spirally in the flow-intake end is exposed to outside and not covered by the covering member; and a shield being hollow and disposed above the fluid-inducing assembly;

wherein external air is induced into each passage through the flow-intake end, flows therealong and exits from the flow-accelerating end and into the shield thereafter, wherein the external air is directed by the passages, is swirled and is accelerated, with the flow-accelerating end accelerating the external air, wherein a flame produced in the device is swirled with a height thereof augmented while a shape thereof is maintained stable, and wherein the flow-intake end is located at a lower position only and the flame is located at a higher position.

2. The device for producing a stable and augmented flame as claimed in claim 1 further comprising a container receiving fuel that is ignited for producing a flame, and wherein the container is received in the fluid-inducing assembly and is circumferentially surrounded by the plurality of vanes and includes an opening through which the flame extends into the shield.

3. The device for producing a stable and augmented flame as claimed in claim 1, wherein the flow-diverting mechanism includes a tube with an enclosed peripheral wall, and wherein the plurality of vanes is circumferentially disposed outside the tube.

4. The device for producing a stable and augmented flame as claimed in claim 3, wherein the flow-diverting mechanism includes a first engaging member and a first enclosure member, wherein the first engaging member includes a first connecting edge and a first receiving edge, wherein the first connecting edge is engaged with a first distal end of the tube to engage the first engaging member with the tube, wherein the first enclosure member includes a first joining edge and a first fixing edge, wherein the first joining edge is engaged with the first receiving edge to engage the first enclosure member with the first engaging member, and wherein a plurality of first gaps formed as the first receiving edge and the first joining edge are engaged with each other.

5. The device for producing a stable and augmented flame as claimed in claim 4, wherein the flow-diverting mechanism includes a base connected thereto and disposed adjacent to the flow-intake end, wherein the first fixing edge is engaged in the base to engage the first enclosure member with the base, and wherein the first enclosure member is restricted from moving relative to the base.

6. The device for producing a stable and augmented flame as claimed in claim 4, wherein the first receiving edge is defined from a plurality of ridges and recesses alternately disposed and circumferentially disposed along a circumferential edge of the first engaging member, wherein the first joining edge is defined from a plurality of ridges and recesses alternatively disposed and circumferentially disposed along a circumferential edge of the first enclosure member, and wherein the recesses and the ridges of the first receiving edge engage with the ridges and the recesses of the first joining edge respectively when the first engaging member is in engagement with the first enclosure member.

7. The device for producing a stable and augmented flame as claimed in claim 6, wherein each recess of the first receiving edge and the first joining edge extends radially and non-concentrically.

8. The device for producing a stable and augmented flame as claimed in claim 4, wherein the flow-diverting mechanism includes a second engaging member and a second enclosure member, wherein the second engaging member includes a second connecting edge and a second receiving edge, wherein the second connecting edge is engaged with a second distal end of the tube to engage the second engaging member with the tube, wherein the second enclosure member includes a second joining edge engaging with the second receiving edge of the second engaging member to engage the second enclosure member with the second engaging member, and wherein a plurality of second gaps is formed as the second receiving edge and the second joining edge are engaged with each other.

9. The device for producing a stable and augmented flame as claimed in claim 8, wherein the second receiving edge is defined from a plurality of ridges and recesses alternately disposed and circumferentially disposed along a circumferential edge of the second engaging member, wherein the second joining edge is defined from a plurality of ridges and recesses alternatively disposed and circumferentially disposed along a circumferential edge of the second enclosure member, and wherein the recesses and the ridges of the second receiving edge engage with the ridges and the recesses of the first joining edge respectively when the second engaging member is in engagement with the second enclosure member.

10. The device for producing a stable and augmented flame as claimed in claim 8, wherein each recess of the second receiving section and the second joining edge extends radially and non-concentrically.

11. The device for producing a stable and augmented flame as claimed in claim 8, wherein each vane includes two attaching ends extending in the same direction, and wherein one attaching end is inserted into and engages in one of the plurality of first gaps to fix to the first engaging member and the first enclosure member and another attaching end is inserted into and engages in one of the plurality of second gaps to fix to the second engaging member and the second enclosure member.

12. The device for producing a stable and augmented flame as claimed in claim 4, wherein each passage includes an included angle defined between a tangent thereof extending from where the passage and the first engaging member interact and a terminal of the passage in the flow-intake end.

13. The device for producing a stable and augmented flame as claimed in claim 1, wherein each vane extends obliquely longitudinally from a first end to a second end and is parallel to the other vanes.

14. The device for producing a stable and augmented flame as claimed in claim 13, wherein each vane extends from the first end to the second end at an angle, which ranges from 30-55 degrees.

15. The device for producing a stable and augmented flame as claimed in claim 1, wherein the plurality of vanes is numbered in a range from 12 to 24 with the plurality of passages numbered in a range from 11 to 23.

16. The device for producing a stable and augmented flame as claimed in claim 1, wherein the shield is with an enclosed circumferential edge.

17. The device for producing a stable and augmented flame as claimed in claim 1, wherein the shield is transparent to light.

18. The device for producing a stable and augmented flame as claimed in claim 1, wherein the covering member supports the shield.

19. A device for producing a stable and augmented flame comprising:

a fluid-inducing assembly including a flow-diverting mechanism defining a flow-intake end and a flow-accelerating end and including a plurality of vanes extending from the flow-intake end to the flow-accelerating end and circumferentially disposed and spaced from one another, with adjacent two vanes of the plurality of vanes including a space defined therebetween and with the space defining a passage which is spiral-shaped, and with the flow-diverting mechanism further including a covering member with an enclosed circumferential edge circumferentially surrounded, wherein each vane in the flow-accelerating end is encircled by the covering member, and wherein each vane in the flow-intake end is exposed to outside and not covered by the covering member; and a shield being hollow and disposed above the fluid-inducing assembly;

wherein external air is induced into each passage through the flow-intake end, flows therealong and exits from the flow-accelerating end and into the shield thereafter, wherein the external air is directed by the passages, is swirled and is accelerated, with the flow-accelerating end accelerating the external air, wherein a flame produced in the device is swirled with a height thereof augmented while a shape thereof is maintained stable, and wherein the flow-intake end is located at a lower position only and the flame is located at a higher position;

wherein the flow-diverting mechanism includes a tube with an enclosed peripheral wall, and wherein the plurality of vanes are circumferentially disposed outside the tube; and wherein the flow-diverting mechanism includes a first engaging member and a first enclosure member, wherein the first engaging member includes a first connecting edge and a first receiving edge, wherein the first connecting edge is engaged with a first distal end of the tube to engage the first engaging member with the tube, wherein the first enclosure member includes a first joining edge and a first fixing edge, wherein the first joining edge is engaged with the first receiving edge to engage the first enclosure member with the first engaging member, and wherein a plurality of first gaps formed as the first receiving edge and the first joining edge are engaged with each other.

* * * * *